United States Patent [19]

Eke

[11] Patent Number: 4,647,746

[45] Date of Patent: Mar. 3, 1987

[54] MICROWAVE OVENS AND METHODS OF COOKING FOOD

[75] Inventor: Kenneth I. Eke, Surrey, England

[73] Assignee: Microwave Ovens Limited, Surrey, England

[21] Appl. No.: 752,592

[22] Filed: Jul. 8, 1985

[30] Foreign Application Priority Data

Jul. 11, 1984 [GB] United Kingdom ..... 8417644

[51] Int. Cl.[4] ..... H05B 6/68

[52] U.S. Cl. ..... 219/10.55 B; 219/10.55 M; 99/325; 426/243

[58] Field of Search ..... 219/10.55 B, 10.55 M, 219/10.55 R, 10.55 E; 99/325, 451, DIG. 14; 426/243, 523

[56] References Cited

U.S. PATENT DOCUMENTS 4,317,977 3/1982 Buck ..... 219/10.55 B
4,379,964 4/1983 Kanazawa et al. ..... 219/10.55 B X
4,390,768 6/1983 Teich et al. ..... 219/10.55 B
4,481,394 11/1984 Tanabe ..... 219/10.55 B
4,484,065 11/1984 Ueda ..... 219/10.55 B X
4,488,025 12/1984 Tanabe ..... 219/10.55 B
4,488,026 12/1984 Tanabe ..... 219/10.55 B
4,499,357 2/1985 Kojima ..... 219/10.55 B
4,533,809 8/1985 Eke ..... 219/10.55 M

*Primary Examiner*—Philip H. Leung
*Attorney, Agent, or Firm*—Penrose Lucas Albright

[57] ABSTRACT

A microwave oven has a magnetron for supplying microwave power to a cavity of the oven, and an electrical resistance heating element over which air is blown by a fan to provide a forced flow of hot air through the cavity. The variation in hot air temperature is monitored, and the slope of the temperature/time variation is sensed after a predetermined time interval from the commencement of cooking with the oven in a cold condition. The sensed slope is then used to predict the time period it will take the hot air temperature to reach a predetermined threshold, and the microwave power and the hot air are discontinued after the predicted time period has elapsed.

7 Claims, 5 Drawing Figures

MICROWAVE OVENS AND METHODS OF COOKING FOOD

FIELD OF INVENTION

This invention relates to microwave ovens and to methods of cooking food.

BACKGROUND TO THE INVENTION

The applicant's copending European Patent Application No. 0122710 discloses a microwave oven having a microwave generator for supplying microwave power to the cavity, a fan for forcing a flow of recirculated hot air through the cavity and means which sense the cavity temperature. If the cavity temperature reaches a predetermined level within a predetermined time the microwave generator and the supply of forced hot air are switched off to finish the cooking process.

The present invention is a development or refinement of the disclosure of the aforementioned European Patent Application.

SUMMARY OF THE INVENTION

According to one aspect of the invention a microwave oven comprises a microwave generator for supplying microwave power to a cavity of the oven, thermal heating means for supplying a forced flow of hot air to the cavity simultaneously with the microwave power, means for monitoring the variation in hot air temperature with time, means for sensing said variation after a predetermined time interval short in comparison with the time taken to cook food items in the oven, and processing means responsive to the sensing means for predicting the time at which the hot air temperature will reach a particular threshold, and means for discontinuing the supply of power to the microwave generator and the thermal heating means after the predicted time has elapsed.

Preferably, the means for monitoring the variation in hot air temperature with time monitor the slope of the temperature time curve, and the predetermined time interval after which the sensing means sense this variation may be between three and eight minutes, conveniently about four or six minutes, from the commencement of cooking with the oven in a cold condition. By sensing the slope of the temperature time curve after the predetermined time interval, the processing means can predict the time at which the cavity temperature will reach a particular threshold, whereupon the oven will switch off and cooking ceases.

The oven may have means for altering the particular threshold temperature so that the user has the choice of selecting a well baked food item or a lightly baked food item (well done or rare in the terminology of cooking meats). Thus if the user selects well baked this increases the particular threshold temperature, and this will increase the predicted time, and therefore the cooking time. Conversely, selecting lightly baked reduces the threshold temperature, shortening the predicted time, and therefore the cooking time.

If, having sensed the slope of the temperature time curve after the predetermined time interval, the processing means predict that the predicted time is longer than a predetermined time (such as thirty minutes) the oven may, when the threshold temperature is reached, continue to operate but with changed rates of power delivered by the microwave generator and the thermal heating means. For example, when the threshold temperature is reached the microwave power may be doubled and the power to the thermal heating means halved, as disclosed in the applicant's aforementioned European Patent Application.

It has been found that the slope of the hot air temperature/time, curve after a short interval of time such as 4 or 6 minutes, is characteristic of the foodstuff being cooked in the oven. Further, it has been found that all foods can be placed in a particular one of plurality of categories by reference to the slope of the temperature time curve after a time period, e.g. four or six minutes. Experiments have shown that a relatively steep temperature time curve is characteristic of baked food items, i.e. pastries, cakes, pies and flans. A somewhat less steep curve is characteristic of heavier food items like joints of meat, particularly beef. A relatively flat temperature/time curve is characteristic of frozen convenience foods. This important result means that sensing the gradient of the temperature time curve after a short predetermined time interval of operation of the oven enables the oven to identify the food item as belonging to one of these three major categories of foodstuffs. Once the oven has identified the category of foodstuff which is being cooked, the oven can automatically select the appropriate magnitude and duration of microwave power and convection (or forced air) power.

According to another aspect of the invention a method of cooking food in a microwave oven having a cavity supplied with microwave power simultaneously with thermal power provided by a forced flow of hot air through the cavity, comprises monitoring the variation in hot air temperature with time, sensing said variation after a predetermined time interval short in comparison with the time taken to cook food items in the oven, using electronic processing means responsive to said sensing means for predicting the time at which the hot air temperature will reach a particular threshold and switching off the microwave power and the thermal power after the predicted time has elapsed.

The forced flow of hot air is preferably blown through the oven cavity by a fan which blows the air over an electrical resistance heating element.

An oven according to the invention will now be described by way of example with reference to the accompanying drawings, in which:

DESCRIPTION OF THE PREFERRED EMBODIMENT

Figure 1:
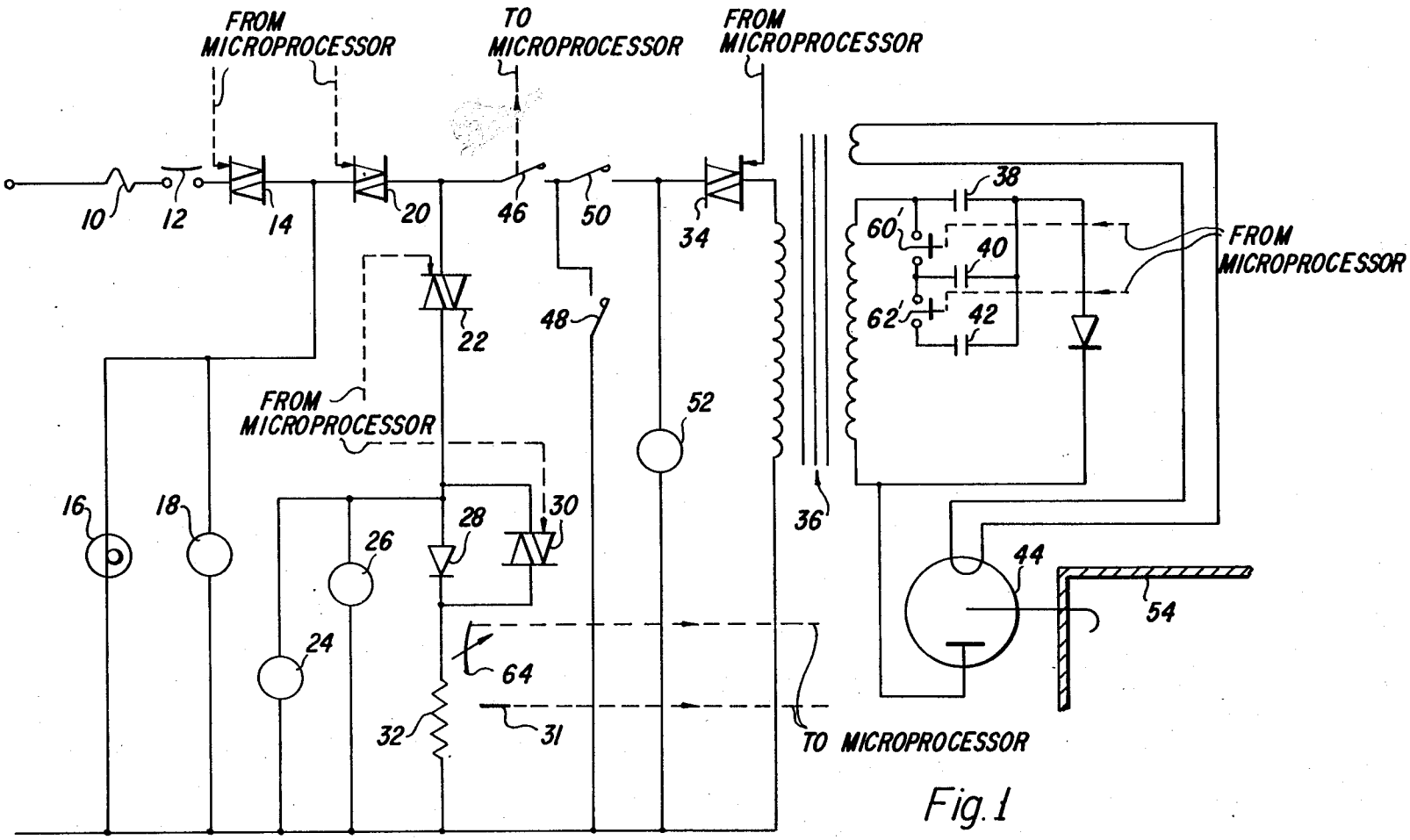
FIG. 1 is an electrical circuit diagram of the oven.

Referring to the circuit diagram of FIG. 1, power is applied from the left-hand side of the Figure through a fuse 10 and a magnetron thermostat 12. A triac 14 controlled by a first timer governs the supply of power to a cavity lamp 16 and a blower 18 for the magnetron. The blower 18 blows a flow of cooling air over the magnetron to cool the latter. Beyond the triac 14 is a further triac 20 which is controlled by a convection timer and through which current must pass before reaching a triac 22 and a parallel network comprising a convection motor 24, a relay 26 for operating a flap or damper, a diode 28 in parallel with a triac 30, and an electrical resistance heating element 32. The convection motor 24 drives a fan for blowing air over the element 32, this forced flow of hot air being recirculated through the oven cavity so as to produce thermal power for browning the food to supplement the microwave power.

A triac 34 forms a microwave on/off switch, and inductive coils 36 transmit power through one or more capacitors 38, 40 and 42 to the magnetron 44. The oven has the usual door latch switch 46, monitor switch 48, cook/start switch 50, turntable 52 and thermostat 64. A portion of the oven cavity is shown schematically at 54.

Figure 2:
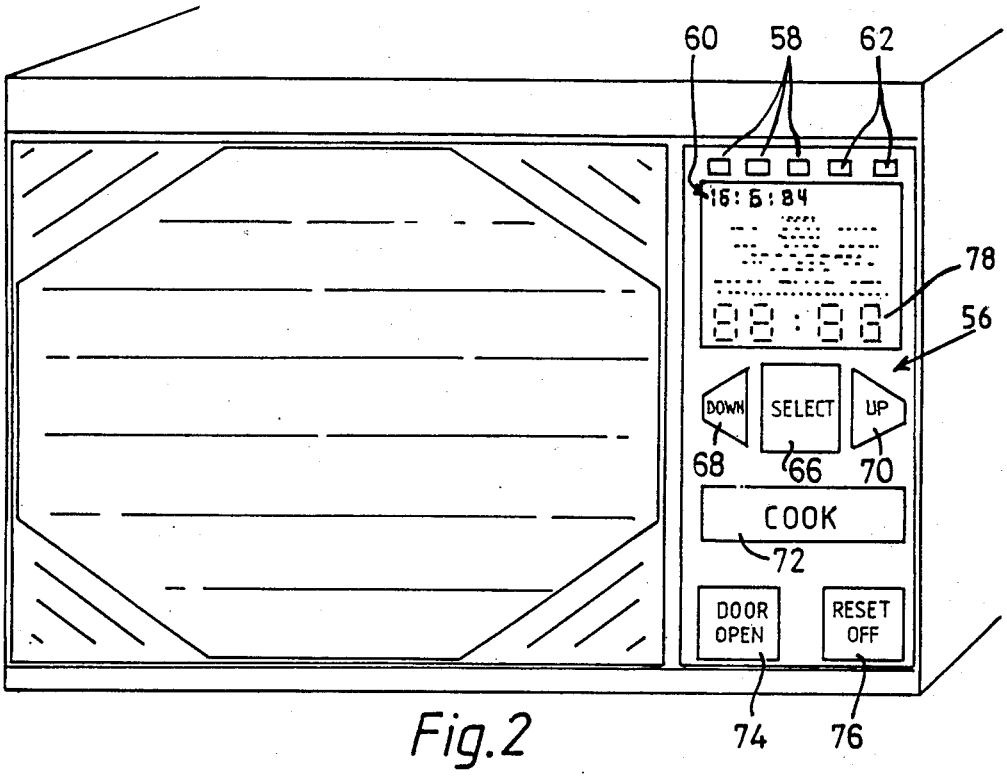
FIG. 2 is a front view of the oven.

The oven has a control panel 56 with displays and touch sensitive pads, as shown in FIG. 2. The panel 56 has three touch pads 58 for setting into a display 60 the date in day, month and year format. Two pads 62 enable the time of day in hours and minutes to be set and to appear in the display 60. The panel 56 also has a "Select" pad 66 between respective "Down" and "Up" pads 68, 70; a "Cook" pad 72; a "Door Open" pad 74 and a "Reset Off" pad 76.

Figure 3:
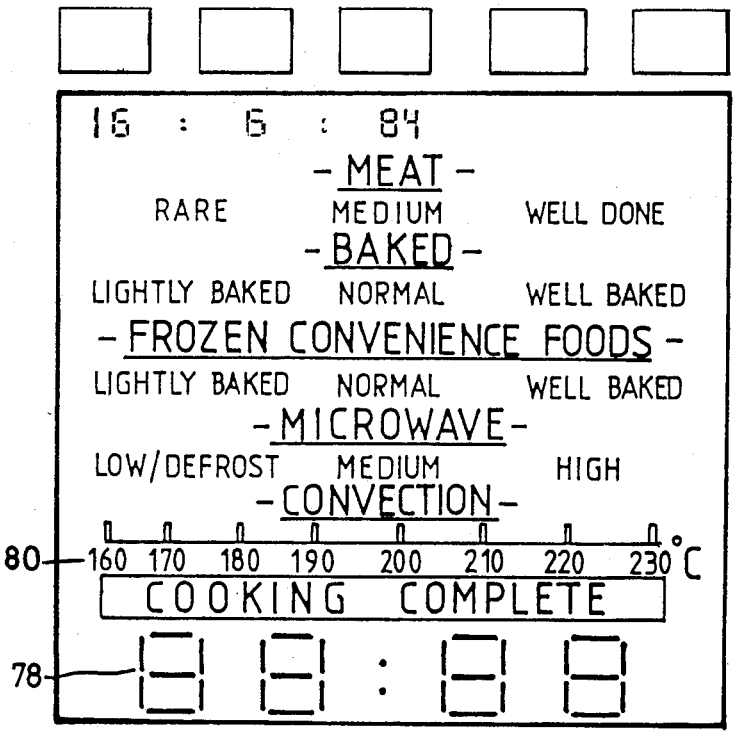
FIG. 3 shows, on an enlarged scale, a display panel of FIG. 2.

FIG. 3 shows the display in greater detail, the date appearing at the top of the display 60 and the time in an alpha-numeric display 78 at the base of the display 60. The display also bears the legends illustrated in FIG. 3, together with a temperature scale 80 and a "Cooking Complete" sign which can be illuminated.

In use the oven is plugged in and the date and time of day set by the pads 58 and 62. The "Select" pad 66 is touched once and the display 60 illuminates the legend "Meat Medium". This turns on the triac 14 which in turn energizes the magnetron blower 18 and the cavity lamp 16. At the same time triacs 22, 30 and 34 are gated on.

If the "Down" pad 68 is touched, the display illuminates "Meat Rare" and if the "Up" pad 70 is touched the display will illuminate "Meat Well Done".

If the "Select" pad 66 is touched a second time the display 60 shows the legend "Baked Normal". The user can select baked foods to be lightly baked or well baked by pressing the "Down" or "Up" pad 68 or 70, respectively upon which the display will show "Lightly Baked" or "Well Baked".

By touching the "Select" pad 66 three times the display 60 shows the legend "Frozen Convenience Foods Normal". Touching "Down" or "Up" pad 68 or 70 causes the legend "Lightly Baked" or "Well Baked" to be displayed.

By touching "Select" pad 66 four times the display 60 shows the legend "Microwave Medium". Touching the "Down" or "Up" pad 68 or 70 causes the legend "Low/Defrost" or "High" power to be displayed.

When "Select" pad 66 is touched five times the display 60 shows "Convection" together with the illuminated temperature scale 80. The temperature will be set at a nominal 200° C. but operation of the "Down" or "Up" pad 68 or 70 causes the set temperature to be decreased or increased, respectively.

Hence, the number of times which the "Select Pad" 66 is touched determines in which of the five modes (meat, baked, frozen convenience foods, microwave and convection) the oven operates.

Assume that the "Select Pad" 66 has been touched twice to signify that a baked item of food, such as a pie, flan or pastry item, is being cooked. Pressing the "Cook" pad 72 then starts the cooking process. The triac 20 is turned on, and the door latch 46 and cook/-start switch 50 are closed and monitor switch 48 is open. Power thus flows through the triacs 22 and 30 to energize the heating element 32 with full wave a.c. current. Also, the convection motor 24 and the relay 26 is energized, the latter closing the flap or damper to divert cooling air from the magnetron blower away from the oven cavity. The triac 34 is also closed and current flows through the coils 36, the magnetron being operated at its low power level through the capacitor 38 because the switches 60' and 62 are open.

Figure 4:
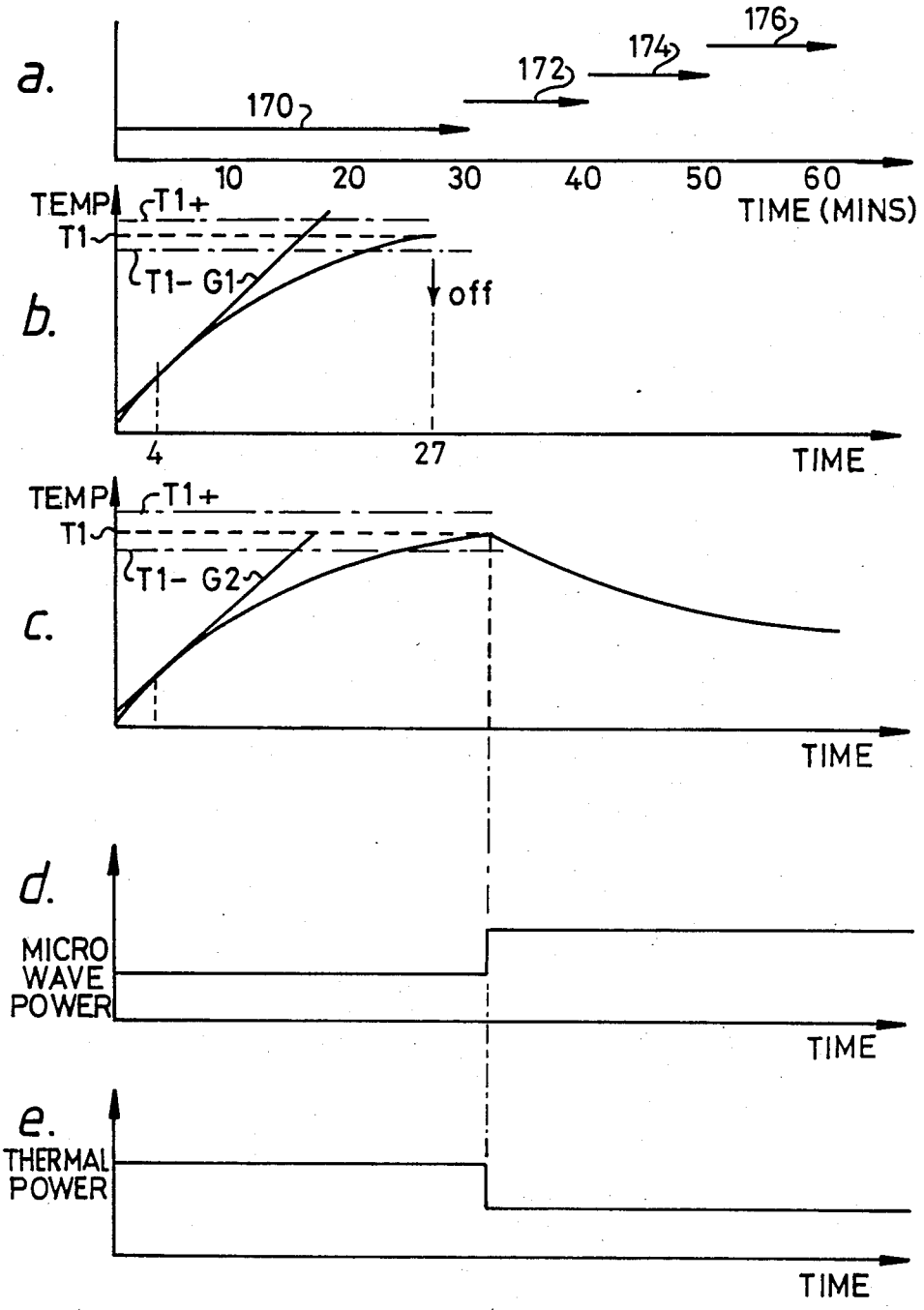
FIGS. 4 and 5 show graphs useful in explaining the operation of the oven.

As cooking proceeds, the hot air temperature rises as indicated in FIG. 4*b*. The temperature of the hot air is sensed by a thermistor 31 positioned to be exposed to the hot air flow immediately after the latter has passed over the electrical resistance heating element 32, as indicated diagramatically in FIG. 1. This sensed temperature is representative of the oven cavity temperature. It has been found that all food items, except for meat, are cooked by the time the hot air temperature reaches a particular threshold T1, typically 250° C. For such food items, this temperature T1 is reached within a predetermined time from a cold start. Rather than detect when this temperature T1 is reached, which can be inaccurate because the curve is becoming more horizontal, the described oven senses the gradient of the time curve after a predetermined time interval. This is done in the following manner. As cooking proceeds, the hot air temperature is sensed by the thermistor forming the temperature sensing means. After a predetermined time interval, e.g. four minutes, the gradient of the temperature/time curve is computed by a microprocessor of the oven. This is shown in 4*b* where the detected gradient G1 is such that the microprocessor can predict that the hot air temperature will reach the predetermined threshold T1 after a total cooking time of about twenty-seven minutes. Accordingly, when the microprocessor has computed the remaining cooking time this time appears on the display 78, counting down to zero whereupon the cooker switches off and the cooking complete sign is displayed.

If the "Down" pad 68 has been touched, because the user wants food lightly cooked, the microprocessor computes the time taken to reach a lower threshold temperature, shown as T1− in FIG. 4*b*. When this time has elapsed (which will naturally be a shorter time than twenty-seven minutes) the cooker will switch off. If the "Up" pad 70 has been touched, because the user wants food well done, the micro-processor computes the time taken to reach a higher threshold temperature, shown as T1+ in FIG. 4*b*. When this time has elapsed, which will be greater than twenty-seven minutes, the cooker will switch off as before. Hence, the detection of the temperature/time gradient at a time of four minutes after the commencement of cooking determines the cooking time.

If during the cooking process, the microwave oven door is opened the illuminated time disappears to signify that the cooking process has been interrupted. When the door is reclosed and cooking recommenced, the micro-processor control circuit resenses the temperature/time gradient and recompute the balance of the cooking time required. This time will then be displayed, with the time counting down to zero as before.

Referring to FIG. 4*a*, the timer 170 runs to the predetermined time of thirty minutes, this being the time span within which all normal baked food items are cooked. As has been mentioned, meat items take longer than the predetermined time of thirty minutes. Operation after the predetermined time of thirty minutes is governed by further timers 172, 174, 176 of the timing means.

FIG. 4*c*, is a plot of hot air temperature against time for a larger food item taking more than thirty minutes to cook. For such a food item, temperature T1 is not reached before time 170 ceases at thirty minutes. Hence, temperature T1 will be reached some time after thirty minutes and this is sensed by the gradient G2 detected at four minutes. Thus gradient G2 predicts that the temperature will be reached some time after thirty minutes and this ensures that, when temperature T1 is reached, the micro-processor switches the microwave power level from low to high (FIG. 4*d*) and the thermal power from high level to low level (FIG. 4*e*). At the same time the micro-processor records that the maximum temperature T1 has been reached. The hot air temperature is monitored between the thirty and forty minute interval, and at forty minutes the timer 172 ceases. If the hot air temperature during this ten minute interval falls to a first sub-level (typically 210° C.) the oven switches off, providing the temperature T1 has previously been reached. If the hot air temperature at forty minutes is above the first sublevel, or temperature T1 has not been reached, cooking continues. The hot air temperature is then monitored between the forty and fifty minute interval, and at fifty minutes the timer 174 ceases. If the hot air temperature during this ten minute interval falls to a second sub-level (typically 190° C.) the oven switches off, providing the temperature T1 has previously been reached. If the hot air temperature at fifty minutes is above the second sub-level, cooking continues until a third sub-level temperature e.g. 170° C. is reached or the timer 176 ceases at sixty minutes.

As before, the predetermined temperature T1 is increased or decreased if the "Up" or "Down" pad has been touched during the precooking selection procedure.

It has been found that the detected gradient of the temperature/time curve after the predetermined time interval, e.g. four minutes, is indicative of the type of food, and that any foodstuff cooked in the oven can be placed in one of three food categories depending on the slope of the temperature time gradient.

Figure 5:
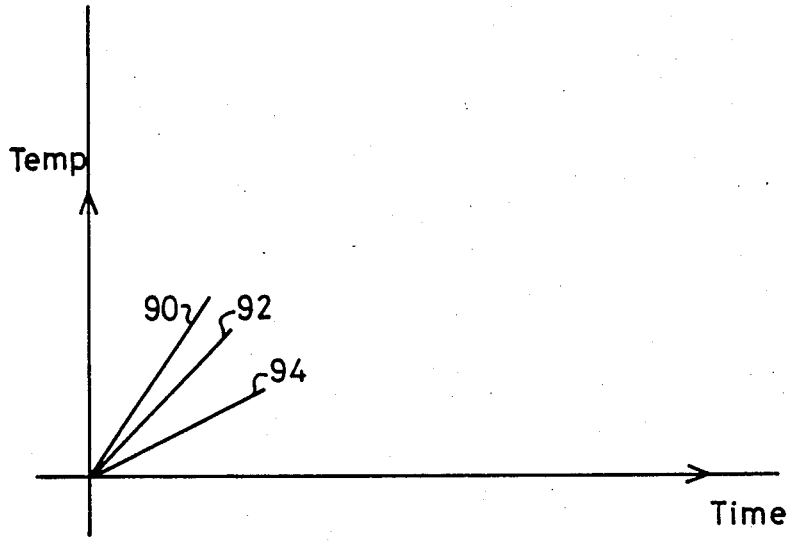

FIG. 5 illustrates three typical gradients 90, 92 and 94 which apply to baked food items, meats, and frozen food items, respectively. Hence, detection of the gradient enables the micro-processor to place the food item in one of the three pre-programmed categories so that once the of the food item being cooked and will thereby select the appropriate magnitudes and durations of microwave power and recirculated hot air power.

Instead of detecting the gradient of the hot air temperature/time curve, the sensing means may sense an alternative characteristic of the curve, such as the integrated area below the curve, to predict when the threshold temperature will be reached.

To enable cooking results to be predictable and repeatable, the oven should always commence from the same starting conditions, i.e. a cold start, which effectively means a hot air temperature below 80° C. If the oven is warm from a previous cooking operation, when the "cook" pad 72 is touched, air from the magnetron blower 18 is directed into the oven cavity, as a result of the relay 26 allowing the flap or damper to move to an open position. When the flap or damper is in the open position, a vent in the oven side wall is uncovered to cause the cooking air flowing past the magnetron to enter the cavity.

When the temperature sensing means detect that the hot air temperature has dropped to a particular value (e.g. less than 80° C.) the relay 26 is energized to cause the flap or damper to close, and cooking commences with the simultaneous application of microwave power and forced hot air. Alternatively, compensation for the warm cavity could be provided by commencing with microwave power alone and introducing forced hot air after a time delay.

I claim:

1. A microwave oven comprising a microwave generator for supplying microwave power to a cavity of the oven, thermal heating means for supplying a forced flow of hot air to the cavity simultaneously with said microwave power, monitoring means for monitoring the variation in hot air temperature with time, said monitoring means monitoring a gradient of a curve of the temperature increase of said hot air plotted against time, sensing means which senses said gradient after a predetermined time interval between about three and eight minutes after commencement of cooking with the oven in a cold condition, processing means responsive to said sensing means which predicts the period of time it will take the hot air temperature to reach a predetermined threshold, and switching control means operative to discontinue the supply of power to the microwave generator and the thermal heating means when said predicted period of time has elapsed if such predicted period of time is shorter than a further predetermined time period or if said processing means predicts that the predicted time is longer than said further predetermined time period provides that the oven continues to operate beyond the threshold temperature but with increased power delivered by said microwave generator and decreased power delivered by said thermal heating means, said sensed gradient of the temperature/time curve after said predetermined time interval being representative of one of three major categories of foodstuff, in that a relatively steep gradient of the temperature/time curve is characteristic of baked food items, a less steep gradient of the temperature/time curve is characteristic of heavier food items such as joints of meat, and a relatively flat gradient of the temperature/time curve is characteristic of frozen foods, said switching control means being responsive to the category of foodstuff which is being cooked as so identified so that magnitude and duration of microwave power and forced hot air power appropriate thereto is automatically executed.

2. A microwave oven according to claim 1, wherein said predetermined time interval is between 4 and 6 minutes from the commencement of cooking with the oven in a cold condition.

3. A microwave oven according to claim 1, wherein the oven comprises means for altering the particular threshold temperature so that the user has the choice of selecting a well baked food item or a lightly baked food item.

4. A microwave oven according to claim 1, wherein said further predetermined time period is thirty minutes.

5. A method of cooking food in a microwave oven having a cavity supplied with microwave power simultaneously with thermal power provided by a forced flow of hot air through said cavity, comprising monitoring a gradient of a curve of hot air temperature plotted against time, sensing said gradient after a predetermined time interval between three and eight minutes from the commencement of cooking with the oven in a cold condition, identifying said sensed gradient of the temperature/time curve after said predetermined time interval as being representative of one of three major categories of foodstuffs in that a relatively steep gradient of the temperature/time curve is characteristic of baked food items, a less steep gradient of the temperature/time curve is characteristic of heavier food items like joints of meat and a relatively flat gradient of the temperature/time curve is characteristic of frozen foods, and automatically selecting and executing an appropriate magnitude of microwave power and forced hot air power in accordance with the category of foodstuff as identified, predicting on the basis of said selected magnitude by electronic processing means the time period it will take for the hot air temperature to reach a particular threshold value, and switching off said microwave power and said thermal power after said time period so predicted has elapsed.

6. A method according to claim 5, wherein the predetermined time interval is between four and six minutes from the commencement of cooking with the oven in a cold condition.

7. A method according to claim 5, comprising the further step of selecting said threshold value.

* * * * *